US005471749A

United States Patent [19]

Brady

[11] Patent Number: 5,471,749

[45] Date of Patent: Dec. 5, 1995

[54] NON-SLIP SEWING RULER

[76] Inventor: John R. Brady, 20041 Osterman, #R4, Lake Forest, Calif. 92630

[21] Appl. No.: 333,428

[22] Filed: Nov. 1, 1994

[51] Int. Cl.[6] ..... B43L 7/00

[52] U.S. Cl. ..... 33/484; 33/485; 33/562

[58] Field of Search ..... 33/484, 11, 18.1, 33/32.1, 32.2, 32.3, 403, 430, 483, 485, 489, 666, 669, 562, 566

[56] References Cited

U.S. PATENT DOCUMENTS

| | | | |
|---|---|---|---|
| 470,754 | 3/1892 | Hartig . | |
| 776,897 | 12/1904 | Ferris | 33/485 |
| 2,026,768 | 1/1936 | Aronson | 33/485 |
| 2,307,892 | 1/1943 | Lowther | 33/485 |
| 2,642,674 | 6/1953 | Schell, Jr. | 33/185 |
| 3,087,250 | 4/1963 | Blue | 33/107 |
| 4,443,953 | 4/1984 | Gregory | 33/403 |
| 4,821,424 | 4/1989 | Loggins | 33/474 |
| 4,926,564 | 5/1990 | Loggins | 33/474 |
| 5,191,716 | 3/1993 | Anderson | 33/483 |

*Primary Examiner*—Christopher W. Fulton
*Attorney, Agent, or Firm*—Stetina Brunda & Buyan

[57] ABSTRACT

A non-slip sewing ruler comprising an elongate guide member including a pair of apertures disposed therein. Releasably attached to the top surface of the guide member is a handle member having a pair of pin members extending therefrom. Each of the pin members defines a pin point which is received into a respective one of the apertures when the handle member is attached to the guide member. The handle member is selectively movable between a first position wherein the pin points reside within the apertures, and a second position wherein the pin points protrude from the bottom surface of the guide member.

8 Claims, 1 Drawing Sheet

Fig. 1
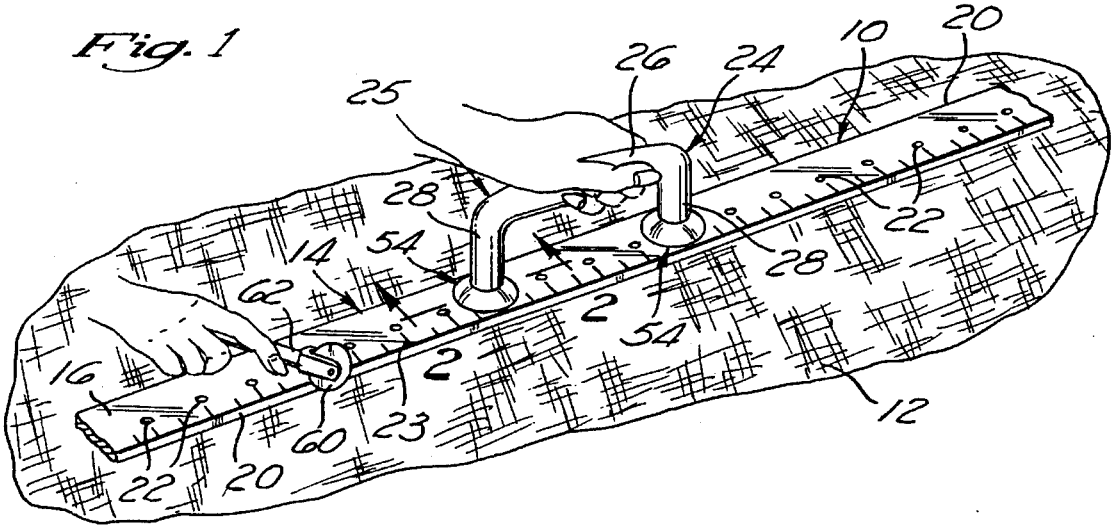
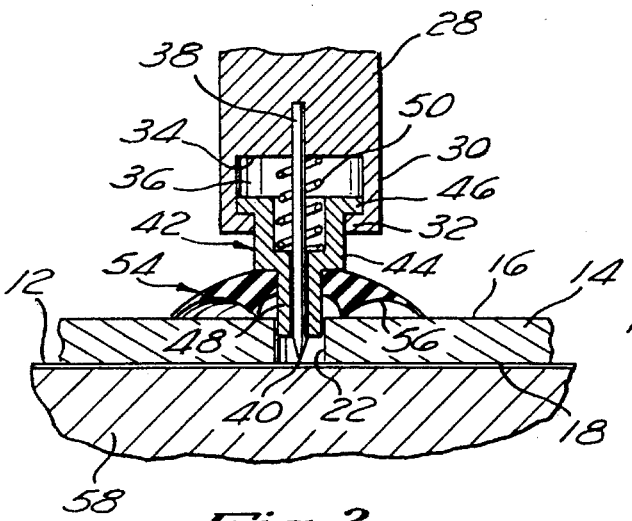
Fig. 2
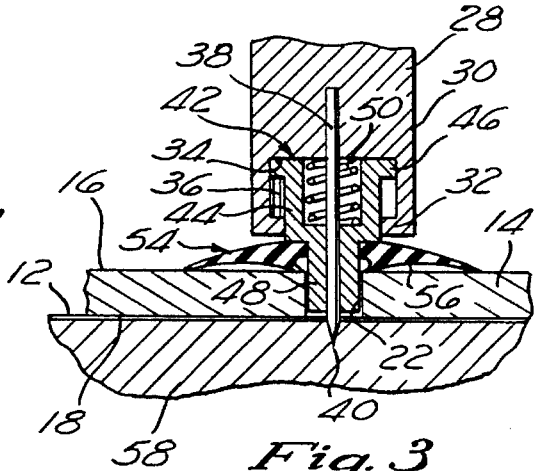
Fig. 3

NON-SLIP SEWING RULER

FIELD OF THE INVENTION

The present invention relates generally to holding devices, and more particularly to a non-slip sewing ruler which is used in relation to the measuring, marking, cutting or trimming of fabric and related materials.

BACKGROUND OF THE INVENTION

In sewing applications, such as quilting, it is often necessary to cut long, straight pieces of fabric. Typically, such fabric is cut through the utilization of a straight edge (such as a ruler, yard stick or tape measure) and a rotary cutter which comprises a circularly configured blade rotatably connected to a handle. During the cutting of the fabric or other material, the blade of the rotary cutter cams against the straight edge to maintain a straight line. However, during such cutting procedures, the straight edge often moves on the fabric, thereby facilitating an improper cut. In addition to moving on the fabric, the straight edge frequently readily permits shifting of the fabric or other material during the measuring, marking or cutting thereof, thus causing the resultant cut piece to be improperly dimensioned. With particular regard to quilting, it is well known that quilt makers often experience difficulties during the laying out of patterns and the cutting of fabric due to the movement of the straight edge on the fabric and/or shifting of the fabric during the cutting of a desired pattern.

In view of the deficiencies associated with prior art straight edges used in relation to sewing applications, applicant has developed a non-slip sewing ruler which is specifically designed to avoid inadvertent movement on the fabric and to prevent the fabric from shifting thereunder during a cutting procedure.

SUMMARY OF THE INVENTION

In accordance with the present invention, there is provided a non-slip sewing ruler comprising an elongate guide member defining top and bottom surfaces and at least one substantially straight side edge. The guide member includes a pair of apertures disposed therein and a measurement scale applied to the top surface thereof.

Releasably attached to the top surface of the guide member is a handle member having a pair of pin members extending therefrom. Each of the pin members defines a pin point which is received into a respective one of the apertures when the handle member is attached to the guide member. The handle member is selectively movable between a first position wherein the pin points reside within the apertures, and a second position wherein the pin points protrude from the bottom surface of the guide member.

In the preferred embodiment, the handle member is releasably attached to the guide member by a pair of resilient gripping members attached thereto. Each of the gripping members has a generally dome-shaped configuration and defines an annular peripheral edge which is configured to be releasably attachable to the guide member via suction pressure. Additionally, each of the gripping members is preferably fabricated from rubber.

The handle member itself preferably comprises a main body portion which has a generally U-shaped configuration and defines opposed ends. Movably attached to respective ones of the opposed ends of the main body portion is a pair of sleeve members which are partially received into respective ones of the apertures when the handle member is attached to the guide member via the gripping members. The pin members extend from respective ones of the opposed ends of the main body portion and through the sleeve members, with the gripping members being attached to respective ones of the sleeve members. The main body portion of the handle member is itself selectively movable between the first and second positions relative to the sleeve members.

In addition to the main body portion and sleeve members, the handle member comprises a pair of biasing springs which are disposed about respective ones of the pin members and extend between the opposed ends of the main body portion and the sleeve members. The biasing springs are operable to bias the main body portion to the first position, and are compressible upon the application of a downward force to the main body portion. The compression of the biasing springs facilitates the movement of the main body portion to the second position.

BRIEF DESCRIPTION OF THE DRAWINGS

These, as well as other features of the present invention, will become more apparent upon reference to the drawings wherein:

FIG. 1 is a perspective view of a non-slip sewing ruler constructed in accordance with the present invention as applied to a sheet of fabric or other material to be cut;

FIG. 2 is a cross-sectional view taken along line 2— 2 of FIG. 1, illustrating the pin members of the handle member in a first, retracted position; and FIG. 3 is a cross-sectional view taken along line 2— 2 of FIG. 1, illustrating the pin members of the handle member in a second, extended position.

DETAILED DESCRIPTION OF THE PREFERRED EMBODIMENT

Referring now to the drawings wherein the showings are for purposes of illustrating a preferred embodiment of the present invention only, and not for purposes of limiting the same, FIG. 1 perspectively illustrates a non-slip sewing ruler 10 constructed in accordance with the present invention. The sewing ruler 10 is typically utilized in sewing applications such as quilting, wherein it is often necessary to make long, straight cuts in a sheet 12 of fabric or other material.

In the preferred embodiment, the sewing ruler 10 comprises an elongate guide member 14 which defines a top surface 16 and a bottom surface 18. The guide member 14 further defines at least one, and preferably an opposed pair of longitudinally extending, substantially straight side edges 20. The guide member 14 is preferably fabricated from wood or plastic, and typically has a generally rectangular cross-sectional configuration. Disposed within the guide member 14 and extending therethrough are a pair of apertures 22 which are identically sized, and positioned in spaced relation along an axis extending longitudinally along the top surface 16 centrally between the side edges 20. Additionally, applied to the top surface 16 of the guide member 14 along at least one of the side edges 20 thereof is a measurement scale 23. The guide member 14 is preferably fabricated so as to have an overall length of three feet, though it will be recognized that the same may be fabricated so as to be of greater or shorter length.

The sewing ruler 10 further comprises a handle member 24 which is releasably attached to the top surface 16 of the guide member 14. In the preferred embodiment, the handle member 24 comprises a main body portion 25 which is generally U-shaped and has a circular cross-sectional configuration. In particular, the main body portion 25 defines an elongate, horizontally oriented central portion 26 and opposed, vertically oriented end portions 28. As best seen in FIGS. 2 and 3, the end portions 28 each terminate into an annular wall portion 30 which includes a lip 32 extending radially inward from the distal end thereof. The wall portion 30, lip 32 and bottom surface 34 of each end portion 28 define a cylindrically configured interior compartment 36 within the distal end of each end portion 28.

Extending axially from the bottom surface 34 of each end portion 28 is an elongate pin member 38 which defines a pin point 40 on the distal end thereof. Each member 38 extends axially through a respective interior compartment 36 and the opening defined by a respective lip 32. Additionally, each pin member 38 is sized such that approximately half of its entire length extends beyond the lip 32.

Movably attached to respective ones of the end portions 28 of the main body portion 25 is a pair of identically configured sleeve members 42. Each of the sleeve members 42 defines a tubular central portion 44 having an annular flange portion 46 extending radially outward from the top end thereof, and a reduced diameter cylindrical portion 48 extending axially from the bottom end thereof. Each sleeve member 42 is attached to a respective end portion 28 in a manner wherein the flange portion 46 thereof resides within the interior compartment 36. In this respect, the outer diameter dimension of the flange portion 46 is slightly less than the inner diameter dimension of the wall portion 30, with the outer diameter dimension of the central portion 44 being slightly less than the diameter of the opening defined by the lip 32. As such, the sleeve member 42, and in particular the flange portion 46 thereof, is slidably movable within the interior compartment 36.

When the sleeve members 42 are attached to respective ones of the end portions 28, each pin member 38 is received into a complimentary bore which extends axially through a respective cylindrical portion 48 and has a diameter slightly exceeding that of the pin member 38. Disposed about each pin member 38 is a biasing spring 50 which extends through a respective interior compartment 36 and into the interior of the central portion 44 of a respective sleeve member 42. In this respect, one end of each biasing spring 50 is abutted against the bottom surface 34 of the end portion 28, with the opposite end thereof being abutted against an annual shoulder 52 which is defined where the central portion 44 of the sleeve member 42 transitions into the cylindrical portion 48.

When the handle member 24 is attached to the top surface 16 of the guide member 14, the distal ends of the cylindrical portions 48 of the sleeve members 42 are received into respective ones of the apertures 22 disposed within the guide member 14. As such, the axes of the apertures 22 are separated from each other by a distance which is substantially equal to the distance separating the pin points 40 from each other. Additionally, when the handle member 24 is attached to the guide member 14, the central portion 26 of the main body portion 25 extends in substantially parallel relation to the axis extending along the top surface 16 centrally between the side edges 20. As will be discussed in more detail below, the main body portion 25 of the handle member 24 is selectively movable between a first position (shown in FIG. 2) wherein the pin points 40 reside within the apertures 22, and a second position (shown in FIG. 3) wherein the pin points 40 protrude from the bottom surface 18 of the guide member 14.

In the preferred embodiment, the handle member is releasably attached to the top surface 16 of the guide member 14 by a pair of identically configured, resilient gripping members 54 which are attached thereto, and in particular to respective ones of the sleeve members 42. As best seen in FIG. 2, each of the gripping members 54 is attached to the central and cylindrical portions 44, 48 of a respective sleeve member 42. Additionally, each gripping member 54 has a generally dome-shaped configuration and defines an annular peripheral edge which circumvents a respective cylindrical portion 48 and includes a continuous, generally concave surface 56 formed there-within. The attachment of the gripping members 54 to the sleeve members 42 is preferably accomplished through the utilization of an adhesive, though other attachment methods may be substituted.

In the preferred embodiment, the gripping members 54 are compressible, and preferably fabricated from rubber, though similar resilient materials may be utilized as an alternative. Each gripping member 54, and in particular the peripheral edge thereof, is releasably attached to the top surface 16 of the guide member 14 via suction pressure which is facilitated by thrusting the concave surface 56 toward the top surface 16. As will be recognized, in order to maintain the suction pressure against the top surface 16, the diameter of each gripping member 54 is sized so as not to extend beyond either of the side edges 20 of the guide member 14 when pressed against the top surface 16 thereof.

Referring now to FIGS. 2 and 3, when the handle member 24 is attached to the top surface 16 of the guide member 14 via the gripping members 54 in the aforementioned manner, the distal ends of the cylindrical portions 48 of the sleeve members 42 are received into respective ones of the apertures 22. Typically, the cylindrical portions 48 are inserted into the apertures 22 prior to the compression of the gripping members 54 against the top surface 16, due to the receipt of cylindrical portions 48 into the apertures 22 facilitating the proper alignment of the handle member 24 relative to the guide member 14. Due to the rigid attachment of the gripping members 54 to the sleeve members 42, prevents the sleeve members 42 are prevented from moving significantly relative to the guide member 14 during the movement of the main body portion 25 between the first and second positions.

Once the handle member 24 has been attached to the guide member 14 via the gripping members 54, the biasing springs 50 bias the main body portion 25 to the first position, as shown in FIG. 2. The upward movement of the main body portion 25 relative to the sleeve members 42 is limited by the abutment of the lips 32 thereof against the flange portions 46 of the sleeve members 42 which, as previously explained, remain substantially stationary relative to the guide member 14. When the main body portion 25 is in the first position, the pin points 40 of the pin members 38 protrude from the distal ends of the cylindrical portions 48 of the sleeve members 42 and reside within respective ones of the apertures 22.

Due to the compressibility of the biasing springs 50, the application of a downward force to the main body portion 25 compresses the biasing springs 50, thus facilitating the movement of the main body portion 25 to the second position. The movement of the main body portion 25 to the second position is accomplished by the downward movement of the lips 32 along the outer surfaces of the central portions 44 of the sleeve members 42, which results in the increased separation of the flange portions 46 from the lips 32. The main body portion 25 reaches the second position when the downward movement thereof is terminated by the abutment of the flange portions 46 of the sleeve members 42 against the bottom surfaces 34 of the end portions 28. Importantly, the downward movement of the main body portion 25 to the second position causes the pin members 38 to slightly advance through the bores of the cylindrical portions 48, and the pin points 40 thereof to protrude from the bottom surface 18 of the guide member 14.

As further seen in FIGS. 2 and 3, due to the resiliency of the gripping members 54, the application of a downward force to the main body portion 25 causes the gripping members 54 to collapse slightly, thus resulting in some advancement of the cylindrical portions 48 of the sleeve members 42 within the apertures 22. However, when the gripping members 54 are fully collapsed, the cylindrical portions 48 do not protrude beyond the bottom surface 18 of the guide member 14. Due to the resiliency of the biasing springs 50, the release of the main body portion 25 of the handle member 24 (i.e., the removal of the downward force therefrom) causes the main body portion 25 to reassume the first position shown in FIG. 2, thus causing the sleeve members 42, gripping members 54, and pin points 40 to reassume their orientations as shown in FIG. 2.

In the preferred embodiment, the vertically oriented end portions 28 of the main body portion 25 are sized such that when the main body portion 25 is moved to the second position, the distance separating the central portion 26 thereof from the top surface 16 of the guide member 14 is sufficient to comfortably accommodate the hand of the user. Additionally, due to the releasable attachment of the handle member 24 to the top surface 16 facilitated by the gripping members 54, the handle member 24 (including the gripping members 54) may be attached to guide members of differing lengths. In this respect, each guide member to which the handle member 24 is applied need only include the apertures 22 disposed therein to accommodate the cylindrical portions 48 of the sleeve members 42.

In use, the handle member 24 is attached to the guide member 14 in the aforementioned manner, with the sewing ruler 10 then being placed in a desired orientation upon the sheet 12 of fabric or other material. Once properly oriented on the sheet 12, the handle member 24 is pushed downwardly by the user's hand, thus causing the pin points 40 to pierce the sheet 12 and engage the underlying support surface 58 such as a table top. Thereafter, the circular blade 60 of a rotary cutter 62 is cammed against one of the side edges 20 (and typically the side edge 20 including the measurement scale 23 extending there along), thus facilitating the cutting of the sheet 12. Importantly, the extension of the pin points 40 into the support surface 58 prevents the inadvertent movement of the sewing ruler 10 upon the sheet 12, and further aids in preventing the sheet 12 from shifting under the guide member 14 of the sewing ruler 10 during the cutting procedure. During the cutting procedure, the handle member 24 is typically grasped by one hand of the user, with the rotary cutter 62 being grasped by the other hand.

Additional modifications and improvements of the present invention may also be apparent to those skilled in the art. Thus, the particular combination of parts described and illustrated herein is intended to represent only one embodiment of the present invention, and is not intended to serve as limitations of alternative devices within the spirit and scope of the invention.

What is claimed is:

1. A non-slip sewing ruler, comprising:

an elongate guide member defining top and bottom surfaces and at least one substantially straight side edge, said guide member including a pair of apertures disposed therein; and a handle member releasably attached to the top surface of the guide member and having a pair of pin members extending therefrom, each of said pin members defining a pin point which is received into a respective one of the apertures when the handle member is attached to the guide member;

said handle member being selectively movable between a first position wherein said pin points reside within the apertures and a second position wherein said pin points protrude from the bottom surface of the guide member.

2. The sewing ruler from claim 1 wherein said handle member is releasably attached to the guide member by a pair of resilient gripping members attached thereto.

3. The sewing ruler of claim 2 wherein each of said gripping members has a generally dome-shaped configuration and defines an annular peripheral edge which is configured to be releasably attachable to said guide member via suction pressure.

4. The sewing ruler of claim 2 wherein each of said gripping members is fabricated from rubber.

5. The sewing ruler of claim 2 wherein said handle comprises:

a main body portion defining opposed ends; and a pair of sleeve member movably attached to respective ones of the opposed ends of the main body portion, said sleeve members being partially received into respective ones of the apertures when the handle member is attached to the guide member via the gripping members;

said pin members extending from respective ones of the opposed ends of the main body portion and through respective ones of the sleeve members, and said gripping members being attached to respective ones of the sleeve members;

said main body portion being selectively movable between the first and second positions relative to the the sleeve members.

6. The sewing ruler of claim 5 wherein said handle member further comprises a pair of biasing springs disposed about respective ones of the pin members and extending between the opposed ends of the main body portion and the sleeve members, said biasing springs being operable to bias the main body portion to the first position and compressible upon the application of a downward force to the main body portion, the compression of the biasing springs facilitating the movement of the main body portion to the second position.

7. The sewing ruler of claim 5 wherein the main body portion of said handle member has a generally U-shaped configuration.

8. The sewing ruler of claim 1 wherein the top surface of the guide member includes a measurement scale applied thereto.

* * * * *